US008607745B2

(12) United States Patent
Malott, Jr. et al.

(10) Patent No.: US 8,607,745 B2
(45) Date of Patent: Dec. 17, 2013

(54) ELECTRO-HYDRAULIC PRESSURE CONTROL FAN DRIVE SYSTEM WITH ELECTRICAL FAILURE MODE OPERATION

(75) Inventors: Theodore A. Malott, Jr., Jackson, MI (US); Joshua L. Roby, Marshall, MI (US)

(73) Assignee: BorgWarner Inc., Auburn Hills, MI (US)

( * ) Notice: Subject to any disclaimer, the term of this patent is extended or adjusted under 35 U.S.C. 154(b) by 262 days.

(21) Appl. No.: 13/127,049

(22) PCT Filed: Oct. 23, 2009

(86) PCT No.: PCT/US2009/061773

§ 371 (c)(1), (2), (4) Date: Apr. 30, 2011

(87) PCT Pub. No.: WO2010/051222

PCT Pub. Date: May 6, 2010

(65) Prior Publication Data

US 2011/0209676 A1 Sep. 1, 2011

Related U.S. Application Data

(60) Provisional application No. 61/197,928, filed on Oct. 31, 2008.

(51) Int. Cl.
*F01P 7/02* (2006.01)

(52) U.S. Cl.
USPC ..... 123/41.11; 123/41.49; 123/41.65; 192/82 T; 192/58.64; 192/59; 192/113.21

(58) Field of Classification Search
USPC ..... 123/41.11, 41.01, 41.49, 41.48, 41.47, 123/41.65; 192/82 T, 58.64, 59, 113.1, 192/113.21, 113.3, 113.31
See application file for complete search history.

(56) References Cited

U.S. PATENT DOCUMENTS

| | | | | |
|---|---|---|---|---|
| 4,961,678 | A * | 10/1990 | Janocko | 415/170.1 |
| 6,217,479 | B1 * | 4/2001 | Brown et al. | 477/86 |
| 7,047,911 | B2 | 5/2006 | Robb | |
| 7,178,656 | B2 | 2/2007 | Pickelman et al. | |
| 7,249,664 | B2 * | 7/2007 | Ignatovich et al. | 192/85.02 |
| 2002/0087244 | A1 * | 7/2002 | Dix et al. | 701/50 |
| 2006/0201771 | A1 * | 9/2006 | Ignatovich et al. | 192/85 AA |
| 2007/0215431 | A1 * | 9/2007 | Pickelman et al. | 192/86 |

* cited by examiner

*Primary Examiner* — Noah Kamen
*Assistant Examiner* — Long T Tran

(57) ABSTRACT

A fan drive system is provided that is hydraulically controlled having an electrical failure mode wherein midrange operation of the fan drive system is maintained. Accordingly, in the failure mode, a fan drive system hydraulic relief valve is not closed thereby ensuring a degree of operation of the fan drive system even during periods of electrical failure.

11 Claims, 5 Drawing Sheets

ELECTRO-HYDRAULIC PRESSURE CONTROL FAN DRIVE SYSTEM WITH ELECTRICAL FAILURE MODE OPERATION

CROSS-REFERENCE TO RELATED APPLICATIONS

This application is a PCT International Application of U.S. patent application No. 61/197,928 filed on 31 Oct. 2008. The disclosure of the above application is incorporated herein by reference.

TECHNICAL FIELD

The invention relates generally to fan drive systems that are hydraulically controlled with integral cooling.

BACKGROUND OF THE INVENTION

Friction coupling devices and fluid coupling devices that drive radiator cooling fans for over the road trucks, such as class 8 trucks, are generally of two types, dry friction clutch assemblies and viscous drives, respectively.

Dry friction clutch assemblies tend to have two operating conditions "ON and OFF" referring to when a friction clutch is either fully engaged or fully disengaged. When a friction clutch assembly is providing cooling the clutch is fully engaged and not slipping. When the friction clutch assembly is not providing cooling the assembly is fully disengaged and slip speed is at a maximum between a clutch plate and an engagement surface.

Dry friction clutch assemblies generally have low thermal capacity since they typically do not incorporate fluid flow cooling mechanisms. Therefore these clutch assemblies have minimal cooling capability and are unable to cycle repeat in short durations of time. The thermal energy that is generated during engagement at high engine speeds can cause the clutch lining to "burn up" or cause the clutch assembly to become inoperative.

Viscous drives, on the other hand, have become popular due to their ability to cycle repeat, engage at higher engine speeds, and operate at varying degrees of engagement. Viscous drives have an operating range of engagement and are generally less engaged at higher engine speeds and generally more engaged at lower engine speeds. Viscous drives never fully engage due to the torque transfer through viscous fluid shear.

Due to the size constraints, viscous drives are also thermally and torsionally limited since viscous drives are always slipping to some degree, they are incapable of turning at fully engaged peak operating speeds. Furthermore, the continuous slipping means viscous drives are continuously generating heat, unlike friction clutch assemblies. Viscous drives are further limited in that as engine cooling requirements increase, larger and more costly viscous drives are required. Thus, some high cooling requirement vehicles viscous drives can become impractical in size and cost.

Due to increasing engine cooling requirements, it is desirable that a fan drive system be capable of not only providing increased cooling over traditional fan drive systems, but also that it have the combined advantages of a friction clutch assembly and of a viscous drive, as stated above, without the associated disadvantages. It is also desirable that the fan drive system be practical and reasonable in size and cost and to be approximately similar to and preferably not to exceed that of traditional fan drive systems.

To overcome the disadvantages of the aforementioned traditional fan drive systems, a new fan drive system has been developed which can be referred to as a solenoid actuated hydraulically controlled fan drive system. A housing assembly is provided which is typically 12-16 inches in diameter. To minimize parasitic drag losses, the housing is not completely filled with hydraulic fluid, but is typically filled such that there is 1-2 inches of hydraulic fluid spaced around a circumference (assuming that the housing is being spun). The fan drive system is engine driven via a belt or chain driven pulley. A stationary bracket rotatably mounts the pulley to the chassis of the vehicle. The pulley is fixably connected to the housing assembly. A clutch assembly within the housing assembly is selectively engaged to connect the rotative fan with the housing assembly. The hydraulic aforementioned clutch is activated via hydraulic pressure. The hydraulic pressure is generated through the use of a pitot tube. The pitot tube is fixably connected to the mounting bracket. The fluid, which is rotating within the housing, is used to generate pressure through momentum exchanged at an aperture in the stationary pitot tube. The pitot tube is also fluidly connected with a piston engaging circuit through which a clutch friction pack engages a fan hub which is rotatably mounted to the housing assembly. To control the amount of fan engagement with the housing assembly via the friction pack, a hydraulic control arrangement is provided. The hydraulic control arrangement regulates the pressure within the piston housing by selectively connecting the pitot tube with a reservoir sump. The reservoir sump occurs due to the void of fluid in the center of the housing assembly. A solenoid actuated relief valve is utilized to selectively regulate the fluid connection between the pitot tube and the low pressure sump formed within the housing assembly. To ensure full engagement of the rotating fan hub with the housing (fan locked in position), the solenoid actuated relief valve completely blocks the sump, causing the full pressure developed by the pitot tube to be applied to the friction pack, which torsionally connects the fan hub with the housing assembly. The amount of torsional connection between the housing and fan hub is varied by utilizing an electronic controller system to selectively open and close the solenoid valve, thereby controlling the amount of pressure applied to the friction pack by the piston.

Since the pressure acting on the piston is controlled by the solenoid, operation of the fan drive system during a period of solenoid or electrical failure must be considered. In most applications, "fail safe" operation provided by a bias spring in the valve that is overcome by the solenoid. In an instance of electrical failure, the spring will close the relief valve, providing full pressure from the pitot tube to the piston. The full pressure will ensure that the fan hub will always be engaged on. However, there are major disadvantages of a failure mode operation wherein the fan is fully engaged. The fully engaged failure mode causes very heavy loads to be placed on the fan even though full cooling capacity is not required. Furthermore, a fully engaged failure mode causes unnecessary fuel consumption and can cause damage to the transmission and accessory belt drive system. Conversely, if the failure mode is such that the fan is permanently disengaged, then the vehicle will not have adequate cooling during most operating conditions. Therefore, it is desirable to provide a failure mode operation for the hydraulically controlled fan drive system which overcomes the aforementioned disadvantages.

SUMMARY OF THE INVENTION

In a preferred embodiment, the present invention provides a fan drive system which is hydraulically controlled that has an electrical failure mode wherein a midrange operation of the fan drive system is maintained. Accordingly, in the failure mode, a relief valve of the fan drive system is not closed thereby ensuring a degree of operation of the fan drive system even during periods of electrical failure. The fan drive system of the present invention has an electrical failure mode which does not fully lock on the fan hub to the fan housing. Accordingly, slippage between the fan and fan hub housing is maintained and therefore shifting operations or abrupt stops of the engine during periods of electrical failure mode operation does not generate as great a concern for damage to the fan belts, fan drive system, or transmission.

The above noted and other features of the present invention will be more apparent to one skilled in the art as the accompanying invention is better described in the accompanying drawings and detailed description.

DETAILED DESCRIPTION OF THE PREFERRED EMBODIMENTS

Figure 1:
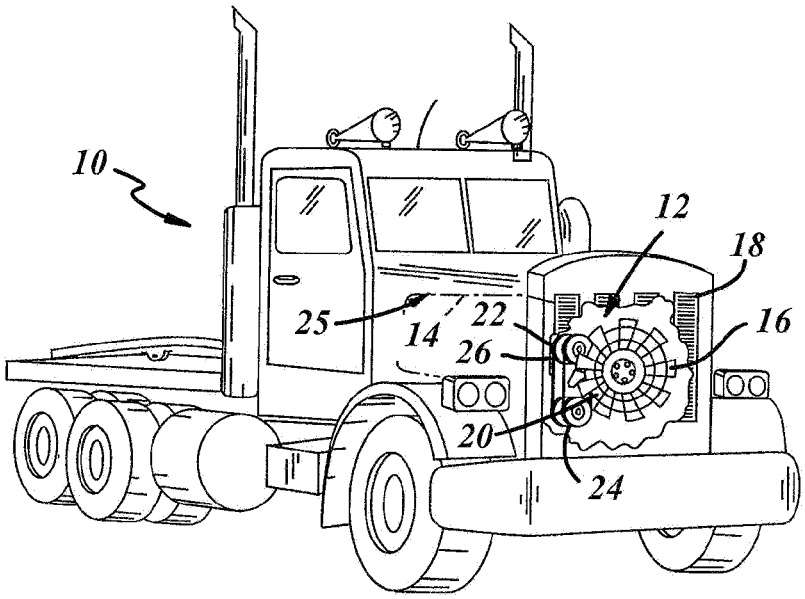
FIG. 1 is a perspective view of a vehicle utilizing a hydraulically controlled fan drive system in accordance with an embodiment of the present invention.

Referring now to FIG. 1, a perspective view of a vehicle 10 utilizing a hydraulically controlled fan drive system 12 in accordance with an embodiment of the present invention is shown. The system 12 uses rotational energy from a liquid cooled engine 14 at an increased ratio to turn a radiator cooling fan 16 to provide airflow through a radiator 18. The system 12 includes a housing assembly 20 fixed to a pulley 22, which is coupled to and rotates relative to a crankshaft (not shown) of the engine 14, via a pair of belts 24, within an engine compartment 25. Of course, the present invention may be relatively operative in relation to various components and via any number of belts or other coupling devices, such as a timing chain. The housing assembly 20 is mounted on the engine 14 via a mounting bracket 26. The housing assembly 20 hydraulically engages the fan 16 during desired cooling intervals to reduce temperature of the engine 14 or to perform other tasks further discussed below.

The fan 16 may be attached to the housing assembly 20 by any suitable means, such as is generally well known in the art. It should be understood, however, that the use of the present invention is not limited to any particular configuration of the system 12, or fan mounting arrangement, or any particular application for the system 12, except as is specifically noted hereinafter.

Figure 2:
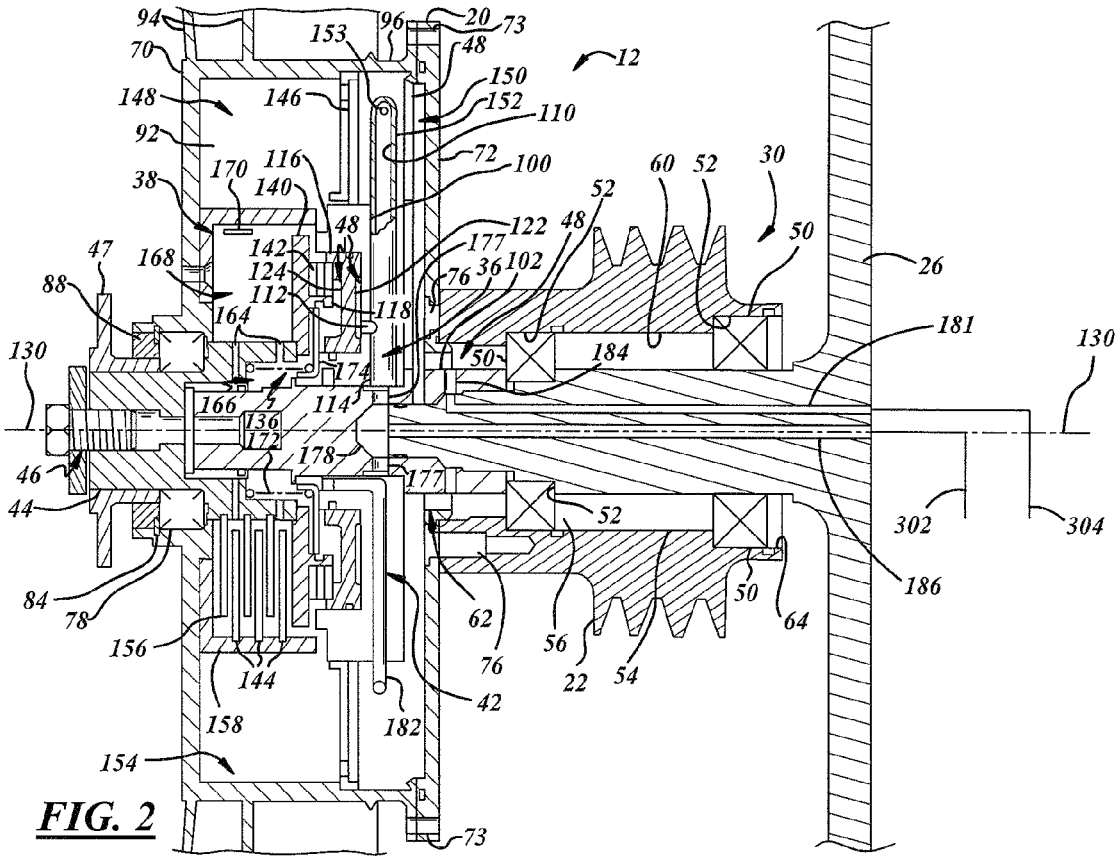
FIG. 2 is a cross-sectional view of a pulley, housing and fan shaft of the fan drive system of the present invention.

Referring now to FIG. 2, a cross-sectional view of the system 12 in accordance with an embodiment of the present invention is shown. The system 12 includes an input circuit 30, the housing assembly 20, a piston 116 assembly, an engaging circuit 36 having a mechanical portion 38 and an electrical portion 40 (FIG. 3), and a variable cooling and lubrication circuit 42. The input circuit 30 provides rotational energy to the housing assembly 20. The engaging circuit 36 engages the housing assembly 20 to a fan shaft 44, via the piston assembly 116, to rotate the fan 16 (FIG. 1). The fan 16 may be coupled to the fan shaft 44 via bolt 46, which is threaded into the fan shaft 44, or by other techniques known in the art, such as being coupled to a fan hub 47. The fan shaft 44 may be a single unit, as shown, or may be split into a fan shaft portion and a clutch shaft portion. The variable cooling circuit 42 provides distribution of hydraulic fluid 48 cooling and lubricating components within the housing assembly 20. The hydraulic fluid may be an oil-based fluid or similar fluid known in the art.

The input circuit 30 includes the pulley 22 that rotates about the mounting bracket 26 on a set of pulley bearings 50. The pulley bearings 50 are held between pulley bearing notches 52, in a stepped inner channel 54 of the pulley 22, and pulley bearing retaining rings (not shown). The pulley 22 may be of various type and style, as known in the art. The inner channel 54 corresponds with a first center opening 62 in the housing assembly 20.

The housing assembly 20 includes a die cast body member 70, and a die cast cover member 72, that may be secured together by bolts (not shown) through bolt holes 73 in the outer periphery of the die cast member 70 and cover member 72. It should be understood that the present invention is not limited to use with a cast cover member, but may also be used with other members such as a stamped cover member. The housing assembly 20 is fastened to the pulley 22, via fasteners (not shown) extending through the cover member 20 into the pulley 22 in designated fastener holes 76. The housing assembly 72 rotates in direct relation with the pulley 22. Bearing 78 is positioned between the housing assembly 20 and the fan shaft 44. The bearing 78 is held within the housing assembly 20 between a corresponding housing bearing notch in the body member 70 and a housing bearing retainer ring 84. A seal 88 resides on a fan side of the housing assembly 20 for retaining the hydraulic fluid 48 within the housing assembly 20.

The body member 70 has a fluid reservoir 92 containing the hydraulic fluid 48. Cooling fins 94 are coupled to an exterior side 96 of the body member 70 and perform as a heat exchanger by removing heat from the hydraulic fluid 48 and releasing it within the engine compartment 25.

The piston assembly 116 includes a piston housing 100 rigidly coupled to a distribution block 102, which is rigidly coupled to the bracket 26. The piston housing 100 has a main pitot tube channel 110 (inside a pitot tube 152), that has a piston branch 112 and a controller branch 114, for flow of the hydraulic fluid 48 to a translating piston 116. The controller branch also connects with to a hydraulic fluid controller 306 (FIGS. 4-5) via line 177, pocket 178, axial stand line 186 and hose line 302. The piston 116 has a pressure side 122 and a drive side 124, with respective pressure and drive pockets. The piston translates along a center axis 130 to engage the housing assembly 20 to the fan shaft 44, via hydraulic fluid pressure from the piston branch 112.

Figure 4:
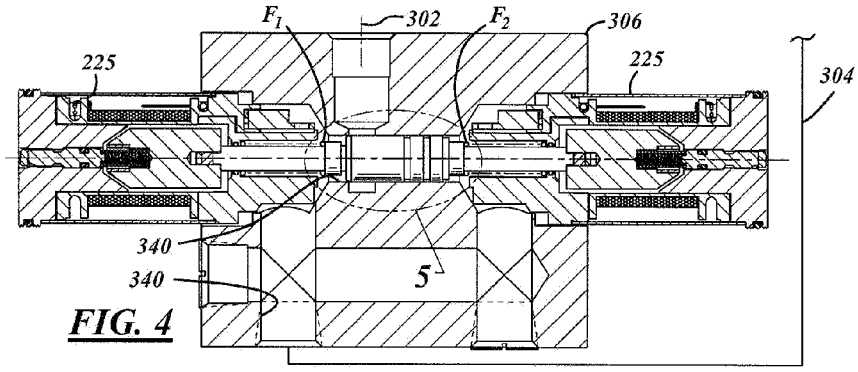
FIG. 4 is a cross-sectional view of a pressure relief valve of a fan drive system of the present invention.
Figure 5:
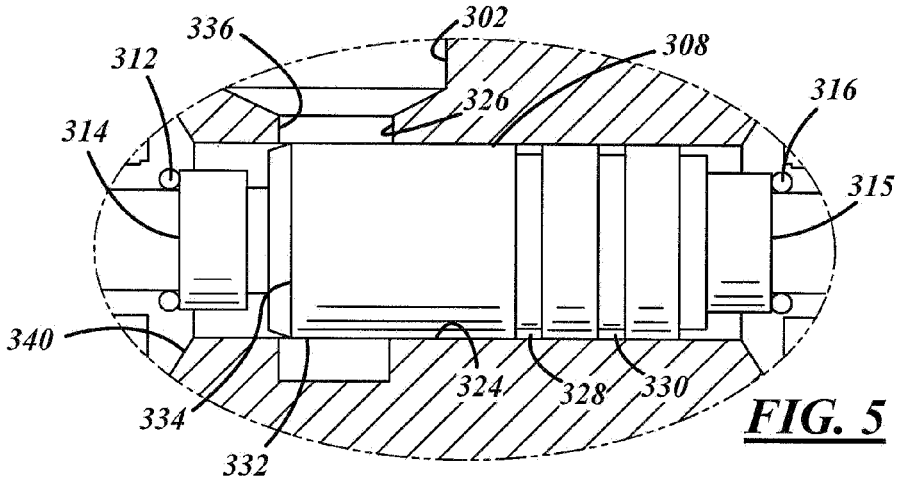
FIG. 5 is an enlargement of the pressure relief valve illustrated in FIG. 4.

The engaging circuit 36 includes a hydraulic fluid supply circuit which is inclusive of main pitot tube channel 110, a clutch plate assembly which includes clutch plates 144, a return assembly 136, and a control circuit which include is inclusive of lines 186, 302 and a remotely located fluid controller 306 (FIGS. 4 and 5). The hydraulic circuit applies pressure on the piston 116 to drive an end plate 140, riding on a separation bearing 142 between the endplate 140 and the piston 116, against clutch plates 144 within the clutch plate assembly 134 and engages the fan 16 (via clutch plates 156 and fan shaft 144). The control circuit controls operation of the piston 116 and engagement of the fan 16. Of course, any number of clutch plates may be used. Also, although a series of clutch plates are utilized to engage the fan 16 other engagement techniques known in the art may be utilized.

The hydraulic circuit may include a baffle 146 separating a relatively hot cavity side 148 from a relatively cool cavity side 150 of the fluid reservoir 92 and the pressure pitot tube 152. The pressure tube 152 although shown as being tubular in shape may be of various sizes and shapes. The pressure tube 152 receives hydraulic fluid 48 from within the cool side 150, providing cooling to the engaging circuit 36, due to flow of the fluid 48 from rotation of the housing assembly 20, carrying the fluid 48 in a radial pattern around an inner periphery 154 of the housing assembly 20. The pressure tube 152 is rigidly coupled within the piston housing 100 and is therefore stationary. The housing assembly 20 is only partially filled with fluid so that the drag of the fluid traveling within the housing 20 is limited. Accordingly, when the housing 20 is spun the fluid tends to by centrifugal force hug the periphery of the housing. Therefore the periphery of the housing has the greatest pressure due to fluid velocity and the center of the housing tends to be the sump region having the lowest fluid pressure. As fluid 48 is circulating about the inner periphery 154, a portion of the fluid 48 enters the pressure tube 152 through an office 153 and applies pressure on the pressure side 122 of the piston 116.

The fan shaft 44 has multiple cooling passageways 164 that extend between a fan shaft chamber 166 and an inner drum chamber 168 allowing passage of fluid 48 therein. Fluid 48, after entering the drum chamber 168, passes across and directly cools the plates 144, 156 and returns to the fluid reservoir 92 through slots 170 in a drum housing 158. The slots 170 may be of various size and shape and have various orientations relative to the center axis 130. The cooling passageways 164 although shown as extending perpendicular to the center axis 130 may extend parallel to the center axis 130, similar to the slots 170.

The return assembly 136 includes a return spring 172 and a spring retainer 174. The spring 172 resides in the fan shaft chamber 166 and are coupled between the fan shaft 44 and the spring retainer 174. The spring retainer 174 has a quarter cross-section that is "L" in shape and is coupled between the piston drive side 124 and the end plate 140. The springs 172 are in compression and exert force on the piston 116 so as to disengage the clutch plates 144, 156 when fluid pressure on the piston pressure side 122 is below a predetermined level.

The cooling circuit 42 also includes a second pitot tube or lubrication tube 182. Although, only a single lubrication tube is shown, any number of lubrication tubes may be used, especially in applications where increased flow is desired. The lubrication tube 182 provides high flow rates at low pressures and as with the first tube may be of various size and shape. Fluid 48, from the cool side 150, enters the lubrication tube 182 and is directed into the fan shaft chamber 166 where it then passes through the cooling passageways 164 and cools the clutch plates 144, 156. Fluid 48 may also exit the fan shaft chamber 166 through the slots 170. Fluid exiting from the fan shaft chamber 166 or the drum housing 158 enters the hot side 148, where the cooling fins 94 dissipate heat from the hot side 148 into the engine compartment 25. The cooling circuit 42 not only cools and lubricates the clutch pack 156 but also other portions of the engaging circuit 36.

Figure 3:
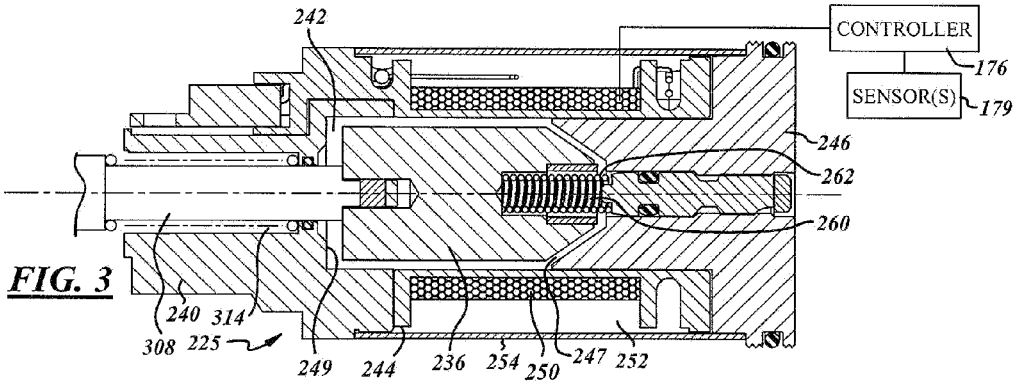
FIG. 3 is a cross-sectional view of one of the solenoid valves utilized in the fan drive system of the present invention.

Referring now to FIGS. 3 and 4, the electrical portion 40 of the control circuit utilizes two solenoid valves 225 (forming a bi-directional actuator) electrically coupled to a main controller 176 to electrically control the fluid pressure within the pitot tube 152.

The solenoid valve assembly 225 includes an armature 236 coupled to a valve spool 308. The valve spool 308 is partially surrounded by a valve body 240, while the armature 236 is positioned within a cavity region 242. A coil bobbin 244 and a pole piece 246 are produced. An air gap 247 is also created between the armature 236 and the pole piece 246.

A coil 250, electrically coupled to a main controller 176, is contained within a cavity region 252 defined between the coil bobbin 244 and a flux tube 254.

The armature assembly 236 is coupled to a spring 260 that is contained within a spring retainer 262 that is contained within the pole piece 246. The spring 260 normally biases the armature 236 toward a shoulder 249 of the valve body 240.

The main controller 176 is electrically coupled to various engine operating sensors 179 and may be contained within the system 12 or may be separate from the system 12 as shown. The main controller 176 is preferably microprocessor based such as a computer having a central processing unit, memory (RAM and/or ROM), and associated input and output buses. The main controller 176 may be a portion of a central vehicle main control unit, an interactive vehicle dynamics module, a cooling system controller, or may be a stand-alone controller as shown. The main controller 176 generates a signal in the form of a pulse width modulated (PWM) current or analog current.

When current is passed through the coil 250 from the controller 176, a magnetic flux is created that extends through the armature 236, air gap 247, pole piece 246 flux tube 254, and valve body 240.

Figure 10:
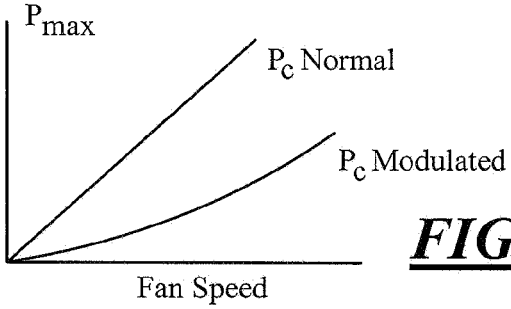
FIG. 10 is a graph comparing maximum pressure in relationship to fan speed during normal operation and during modulated operation due to an electrical failure.

The fluid controller has two solenoid valve assemblies 225 which are opposing one another as shown in FIG. 4. The solenoid assemblies are connected together via the valve spool 308 which translates in valve bore 324 (FIG. 5). Valve spool 308 is biased to the right by spring 312 pushing against shoulder 314 to provide a first biasing force F1. The spool 308 is biased to the left by spring 316 which pushes against shoulder 315 providing a biasing force F2. The valve bore 324 intersects with a transverse passage 326 which is in turn connected with the hose line 302. Balancing grooves 328 and 330 are provided to reduce spool drag. Adjacent to the transverse passage 326, the spool valve 308 has a landing 332 with a metering edge 334. The metering edge 334 is typically positioned to have a very small leakage by being positioned closely adjacent to a leading edge 336 of the transverse passage 326 (the position shown in FIG. 5 is exaggerated to the right for illustrative purposes). To obtain maximum pressure (Pc Normal FIG. 10) on the piston pressure side 122 (and thereby obtain maximum fan 16 engagement), the solenoids 225 position the landing 332 to cutoff transverse passage 326 from sump port 340 (FIG. 4).

Sump port 340 is connected with a second sump line 304. The sump line 304 is connected with a mounting base axial line 181 (FIG. 2) intersecting with a mounting base radial line 184 allowing fluid therein to pass into first center opening 62.

To modulate the pressure on the pressure side 122 of piston 116, the controller 176 controls the two solenoid valves 225 to allow an opening of line 302 by powering the solenoid valves 225 to provide for a controlled leakage by moving the spool valve 308 in a rightward direction. To release the fan 16 from the housing 20, the right solenoid valve 225 is powered to move the spool to its furthest rightward position, fully connecting the pressure side 122 of the piston 116 with the sump line 340. This control scheme can be accomplished through proportional control or with pulse width modulation. Upon an electrical failure, the position of the spool 308 will be determined by the opposing forces (FIGS. 1 and 2) exerted upon the spool valve by the two springs 312 and 314. Accordingly, at virtually all engine speeds, a mid-pressure force (Pc modulated—See FIG. 10) will be present to partially engage the fan 16 with the housing 20. Furthermore, this partial engagement mode will provide an appropriate minimum amount of engine cooling. Additionally, the failure mode operation will not lock the fan 16 to the housing 20, preventing extreme loading on the belts and pulleys during transmission shifting.

Figure 7:
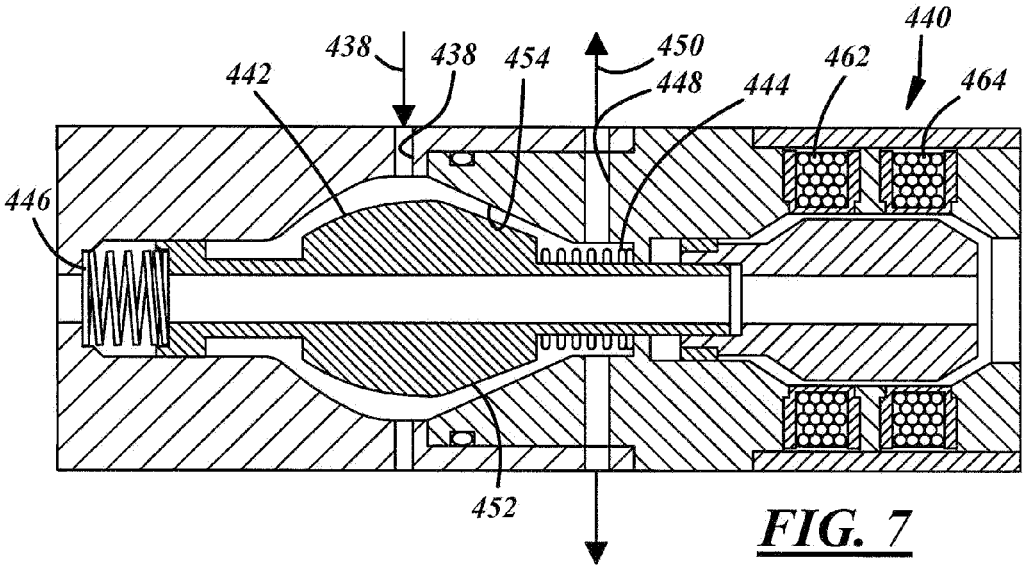
FIG. 7 is an enlargement of a portion of a relief valve in the fan drive system shown in FIG. 6.
Figure 8:
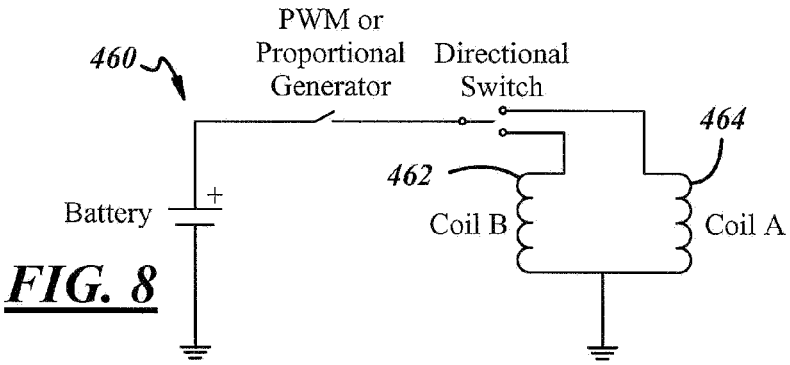
FIG. 8 is an electrical schematic illustrating the operation of a solenoid in the relief valve shown in FIG. 7.
Figure 6:
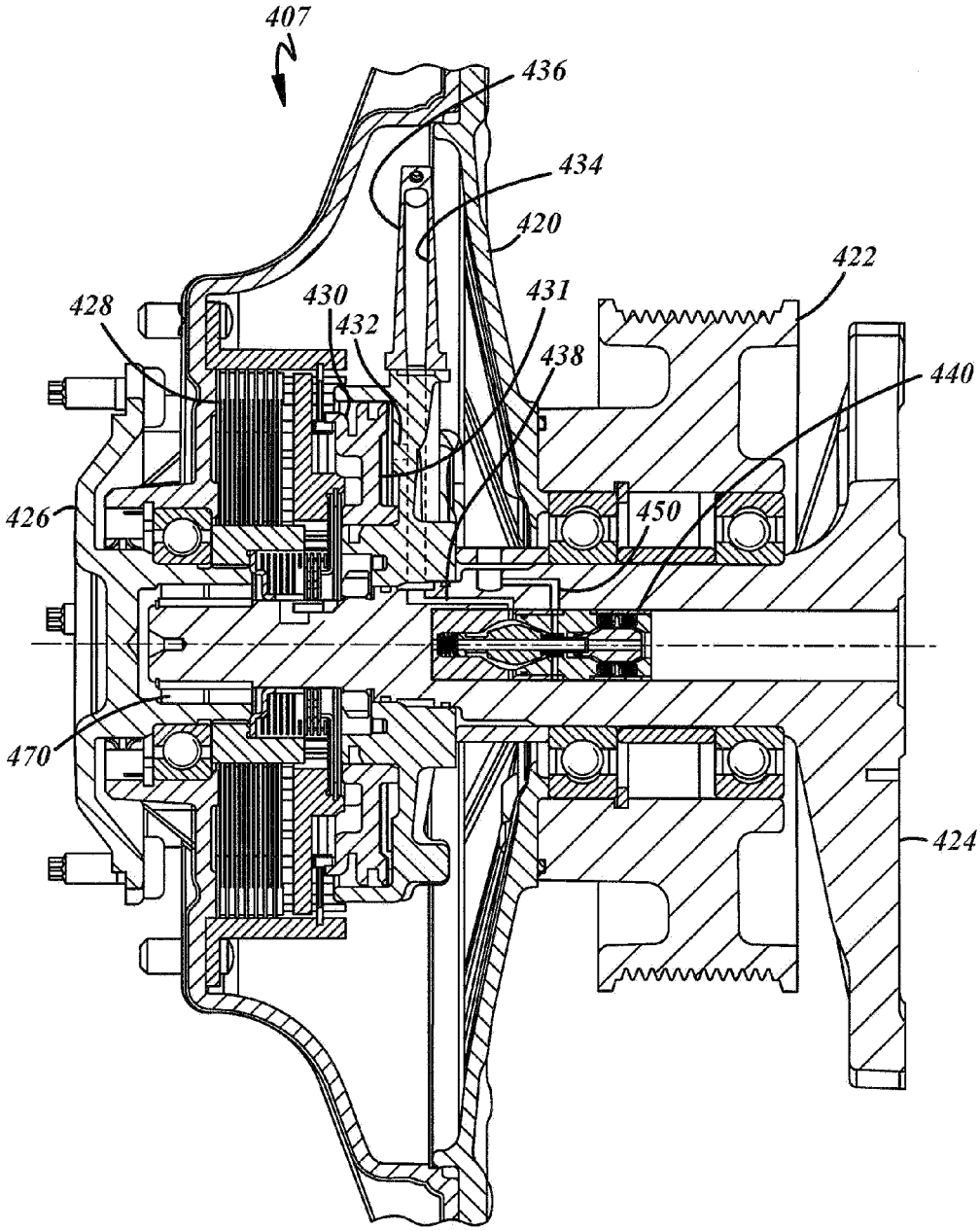
FIG. 6 is a sectional view similar to that of FIG. 2 of another preferred embodiment fan drive system of the present invention.

Referring to FIGS. 6-8, a preferred embodiment fan drive assembly according to the present invention is provided. Fan drive assembly 407 functions in a manner similar to that of fan drive system 12 having a housing 420 driven by a pulley 422 which are rotatably mounted on a base 424. The housing 420 can be selectively joined with a fan hub 426 by engagement of a clutch pack 428 actuatable by a piston 430. The piston 430 is pressurized in a manner as afore described through a line 432 which insects with a line 434 provided in a pitot tube 436. Pitot tube line 434 is connected with a line 438. Line 438 as shown in FIG. 7, enters into a pressure controller 440 which is mounted within a portion of base 424 that is surrounded by the pulley 422 and housing 420. The controller 440 has an opposing dual spring biased spool 442 which is biased by springs 444 and 446. Springs 444 and 446 provide corresponding F1 and F2 forces acting upon the spool 442. An exhaust line 448 connects with a sump line 450 provided in the base 424. The valve spool 442 has a conical surface 452 for selective mating engagement with a conical valve seat 454. When mated against the conical valve seat 454, the spool 442 cuts off fluid communication from line 438 to line 448 thereby ensuring maximum pressure within the pressure side 431 of the piston 430. During normal operation, the position of valve spool 442 is controlled by a circuit 460. Control circuit 460 controls a dual coil solenoid actuator having coils 462 and 464. Coil 462 can be actuated to cause valve spool 442 to be shifted to the left as shown in FIG. 7, line 438 is placed in fluid connection with line 448 essentially causing the pressure chamber 431 of the piston to be evacuated to sump and therefore ensuring non-engagement of the fan hub 426 with the housing 420. Activation of coil 464 causes the valve spool 452 to be shifted to the right causing its valve surface 452 to engage with valve seat 454 thereby closing off fluid communication of line 438 with line 448 and ensuring maximum pressure available within the piston pressure chamber 431. Upon an electrical failure, springs 446 and 444 will modulate the maximum pressure available in the pressure side 431 of the piston in a manner as previously described with springs 312 and 314.

Figure 9:
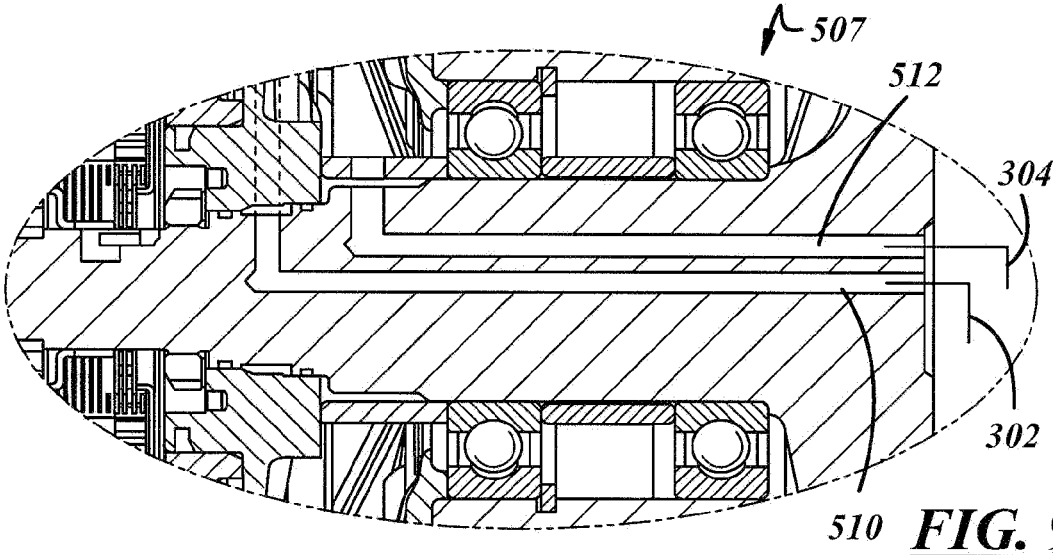
FIG. 9 is a partial sectional view of still another embodiment of the present invention in which the relief valve is external to the fan drive system.

Referring to FIG. 9, a partial portion of a fan drive assembly 507 is provided. Fan drive assembly 507 has a line 510 which is in turn connected line 302 as previously described for the fan drive assembly shown in FIGS. 1-4. Fan drive assembly 507 also has a line 512 which is provided with a sump line 304 as previously described for the fan drive shown in FIGS. 1-4. The control of the fan drive assembly 507 will be essentially identical as that as previously described for the dual solenoid relief valve type controller 306.

Fan drives 407 and 507 are essentially similar to fan drive 12. In fan drives 407 and 507, the base 424 directly supports the fan hub 426 via needle bearings 470.

Those skilled in the art can now appreciate from the foregoing description that the broad teachings of the present invention can be implemented in a variety of forms. Therefore, while this invention has been described in connection with particular examples thereof, the true scope of the invention should not be so limited, since other modifications will become apparent to the skilled practitioner upon a study of the drawings, specification and following claims.

The invention claimed is:

1. A hydraulically controlled fan drive system comprising:

a housing assembly containing a hydraulic fluid within a fluid reservoir; and an engaging circuit coupled to said housing assembly and comprising a first pitot tube coupled within said housing assembly and receiving at least a portion of said hydraulic fluid from said fluid reservoir, said portion of said hydraulic fluid defining a fluid pressure within said first pitot tube;

said engaging circuit engaging said housing assembly to a fan shaft in response to said fluid pressure within said first pitot tube; and a control circuit for controlling said fluid pressure within said first pitot tube, said control circuit comprising a main controller electrically coupled to a relief valve assembly, said control circuit providing selective continuously variable control of said pressure within said first pitot tube and where upon an electric failure, said pitot tube pressure is mechanically modulated to a mid-pressure failure mode wherein said relief valve assembly comprises: a valve body having an inner cavity and a pair of vents; a coil bobbin coupled to said valve body; a pole piece closely coupled to said coil bobbin; a flux tube coupled to said pole piece; a spring retainer coupled within said pole piece; a spring coupled to said spring retainer an contained within a cavity region, said cavity region defined by said valve body, said coil bobbin and said pole piece; an armature assembly coupled within said inner cavity and said cavity region, said armature assembly having a valve and an armature, said armature closely coupled to said spring within said cavity region and said valve contained within said inner cavity, wherein said armature assembly is capable of axial movement within said inner cavity and said cavity region towards and away from said spring between an open position and a closed position, said closed position defined wherein said valve seals to said pair of vents and wherein said valve unseals from said pair of vents to allow said hydraulic fluid to pass from said first pitot tube through said vent and to said fluid reservoir; and a coil electrically coupled to said main controller and contained between said flux tube and said coil bobbin, said coil generating a magnetic flux proportional to an electric current supplied from said main controller, said magnetic flux moving said armature assembly from said closed position to said open position.

2. A system as in claim 1 wherein said engaging circuit further comprises: a clutch plate assembly coupled to said housing assembly and to a fan shaft and having at least one clutch plate; and a piston applying pressure on said at least one clutch plate.

3. A system as in claim 2 wherein said piston applies direct pressure on at least one clutch plate and engages said fan shaft to said housing assembly.

4. A system as in claim 1 further comprising variable cooling circuit, said circuit comprising a second pitot tube coupled within said housing assembly and supplying said hydraulic fluid to and cooling said engaging circuit.

5. A system as described in claim 1 wherein said relief valve is acted upon by two opposing springs.

6. A system as described in claim 1 wherein said relief valve is acted upon by dual solenoid actuators.

7. A system as described in claim 6 wherein said dual solenoid actuators are remotely located.

8. A system as described in claim 1 wherein said relief valve is surrounded by a rotating portion of said fan assembly.

9. A system as described in claim 8 wherein said relief valve is powered by a dual coiled solenoid.

10. A system as described in claim 1 wherein a stand of said fan assembly directly rotatably supports a hub of said fan.

11. A hydraulically controlled fan drive system comprising:

a housing assembly containing a hydraulic fluid;

a pulley connected to said housing assembly for turning said housing assembly;

a fan shaft rotatably mounted to said housing by a hydraulically actuated clutch;

a piston slidably mounted with a piston housing for actuating said clutch;

a stationary pressure tube for delivering hydraulic fluid pressure within said housing assembly to said piston housing;

a relief valve for controlling the fluid pressure within said piston housing by selectively connecting said piston housing with a sump;

a controller having bi-directional electrically powered actuation for positioning said relief valve, said controller having mechanical springs to modulate said relief valve upon electrical failure and a relief valve assembly, said relief valve assembly electrically coupled to said controller and comprising a coil bobbin and a biased armature assembly, wherein magnetic flux supplied by said main controller operates to move said armature assembly from a closed to an open position allowing hydraulic fluid to pass to said stationary pressure tube.

* * * * *